United States Patent [19]

Swanson

[11] 4,017,722

[45] Apr. 12, 1977

[54] CONTROL SYSTEM FOR TEXTILE TENTER FRAME

[75] Inventor: S. Keith Swanson, Saratoga, Calif.

[73] Assignee: Measurex Corporation, Cupertino, Calif.

[22] Filed: Apr. 11, 1975

[21] Appl. No.: 567,108

[52] U.S. Cl. ..... 235/151.1; 26/51.5; 26/86

[51] Int. Cl.[2] ..... D06C 3/00

[58] Field of Search ..... 235/151.1, 151.13, 92 PD, 235/92 V, 92 QC; 26/51.5, 53, 56, 57 A, 57 R, 57 E, 60, 68; 34/52

[56] References Cited

UNITED STATES PATENTS

| | | | |
|---|---|---|---|
| 2,466,446 | 4/1949 | Laurie | 34/52 |
| 3,021,607 | 2/1962 | Fleissner | 34/115 |
| 3,619,360 | 11/1971 | Persik, Jr. | 235/151.1 |
| 3,641,349 | 2/1972 | Dahlin | 250/83.3 H |
| 3,649,444 | 3/1972 | Futch, Jr. | 162/198 |
| 3,721,809 | 3/1973 | Strandberg, Jr. et al. | 235/92 PD |
| 3,757,122 | 9/1973 | Bossen et al. | 250/358 |
| 3,801,252 | 4/1974 | Waterhouse | 26/68 |
| 3,814,914 | 6/1974 | List et al. | 235/151.1 |
| 3,857,023 | 12/1974 | McCall | 235/151.1 |

*Primary Examiner*—Malcolm A. Morrison
*Assistant Examiner*—Errol A. Krass
*Attorney, Agent, or Firm*—Owen, Wickersham & Erickson

[57] ABSTRACT

A method and apparatus for controlling the yield of fabric material from a tenter frame having spaced apart belts driven by drive means and an overfeed roll at its entry end. In a start-up or style change mode of operation a predicted dry yield is computed from data signals received before the fabric enters the tenter frame, then compared with a target value to produce a control signal to the overspeed roll. In the steady state mode of operation, actual yield is computed from data taken at the output end of the tenter frame; then is compared with a target yield value and thereafter modified by a correction factor proportional to variations in predicted dry yield computed from inputs taken at the entry to the tenter frame; the modified control signal again being applied to the overspeed roll.

7 Claims, 2 Drawing Figures

CONTROL SYSTEM FOR TEXTILE TENTER FRAME

BACKGROUND OF THE INVENTION

This invention relates to an automatic control system for a textile tenter frame apparatus.

In the process of finishing textile goods which are knit either completely or partially from synthetic materials, the goods are processed through a tenter frame where they are raised to a temperature sufficiently high to cause the material to be in a plastic state. The tenter hooks or pins on the frame fix the mechanical dimensions of the material and the process thus "sets" the material to that dimension. Since textile goods are sold by the lineal yard with a guaranteed weight per lineal yard, called yield, and since variations in yield of the knit fabric typically occur at the knitting machines due to variations in yarn weights and knitting conditions, an overfeed roll is normally employed at the entrance to the tenter frame. This overfeed roll is run at either a faster or slower rate than the tenter frame speed to produce finished yields that are either higher or lower than the yields resulting from the knitting operation. Heretofore, the operator made periodic adjustments to the overfeed roll speed based on his experience with the particular fabric being run and from finished yields actually obtained at the exit of the tenter frame.

Additional problems in the fabric finishing operation which are related to the wide variations that exist in the knitting operations included the relationship of the length of the knit pieces fabric received from the knitting machines compared to the length of the tenter frame and the variations of moisture levels in the knit goods as they enter the tenter frame. Pieces of knit goods are generally made in lengths of 40 to 50 yards due to mechanical limitations of the knitting machines producing the goods. These mechanical limitations are generally storage capacity limitations on the knitting machines themselves and presently attainable knitting speeds. The usual high production rates required in fabric production preclude use of a single knitting machine to produce an ordered style. Consequently, to provide a more continuous tentering operation, pieces of a given style which have been produced by a number of knitting machines are sewn together and fed continuously to the tenter frame. Further, because of the short style runs which are generally 20 to 30 pieces, styles are run contiguously by sewing the first piece of one style to the last piece of its predecessor. The aforesaid procedure created another problem in fabric processing.

The length of a typical tenter frame is in the order of 25 to 30 yards. Therefore, by the time a piece of fabric goods begins its exit from the tenter frame, at least one half of the piece is in the frame itself. Thus, any subsequent control moves to the overfeed roll based on exit fabric yield will affect, at best, one half of the piece being finished. Control moves based on the yield of the second half of a particular piece, based on its exit yield as it leaves the tenter frame, will be made on the next following piece whose entrance (as knitted) yield does not necessarily have a relationship to the entrance yield of the preceding pieces.

Prior to the present invention, control of the yield was attempted by mechanically determining the yield of finished pieces using a scale and length accumulator and notifying the operator at the entrance to the tenter frame of deviations from target yield. He would then make adjustments to the overfeed drive control based on the observed error. Since, as described above, variations in fabric yield as knitted are not necessarily related within a given style, these operator changes to overfeed speed were often incorrect for the piece of fabric then being finished.

Subsequent attempts to improve yield control involved the placement of a weight measuring device at the exit of the tenter frame which measured specific weight (ounces per square yard) of the fabric. This weight was then combined with the target exit width of the fabric and subsequent control moves were made to the overfeed drive control based on the calculated yield (ounces per lineal yard) of the fabric. As mentioned above, piece to piece variations in entry yield were not accounted for nor were variations in actual exit width as compared to target exit width.

In an attempt to improve the above system another weight measuring device, in addition to the weight measuring device at the tenter frame exit, was installed at the entrance to the tenter frame between the overfeed roll and the mechanical water removal device (if one existed). Based on an assumed water content, the entry weight was calculated and feed forward control moves were made to the overfeed roll in addition to the feedback control from the exit weight measuring systems. However, this method suffered from two major shortcomings. First, as mentioned above, substantial variations in moisture at the entry to the tenter frame were not accounted for but were interpreted as entry yield variations, giving rise to inaccurate control moves. Secondly, wide variations in fabric width at the entry to the tenter frame (prior to securing the fabric to the tenter hooks or pins) were experienced. Thus, a variation in width causing subsequent variations in specific weight at the entry to the tenter frame were interpreted as variations in entry yield, thereby giving rise to inaccurate control moves.

OBJECTS AND SUMMARY OF THE INVENTION

It is therefore an object of the invention to solve the aforementioned problems related to variations in entry yield caused by entry moisture variations in fabric processing apparatus.

A further object of the invention is to solve the problems with fabric processing as mentioned above with regard to entry width variations.

Yet another object of the invention is to provide an automatic control system for fabric processing apparatus that will produce a constant yield of knitted fabric in ounces per lineal yard at the exit of a tentering frame regardless of variations of entry yield of the knit fabric and regardless of variations of fabric moisture content and regardless of variations in fabric width at the entry to the tenter frame.

A further object of the present invention is to provide an automatic control system for a fabric tenter frame apparatus that will provide yield control for both the steady state condition and also during start-up or style change periods of operation.

The foregoing and other objects are accomplished by a control system according to the present invention which is effective to control yield in either the start-up or style change mode of operation and also in steady-state operation. For the start-up or style change mode, a predicted dry yield is determined using scanning weight and moisture sensors located at the entry of the tenter frame for measuring the entry fabric specific weight and moisture content. In addition, width sensors are mounted at the same location to determine the fabric width at the entry to the tenter frame while speed sensors are mounted at the overfeed roll and chain drive shaft. The signals from these sensors are combined at a digital processor wherein the data is computed to predict the exit dry yield of the fabric for the present conditions. Within the processor this predicted exit yield is compared with a preset target yield to produce control signals to the overfeed roll of the tenter frame apparatus. Appropriate control actions are made to the tenter frame in response to the control signals to correct for predicted variations from the target yield. For the steady state mode, scanning weight and width sensors located at the exit of the tenter frame are used for measuring the fabric specific weight and width. The signals from these sensors are combined at the digital processor to determine a value for the actual exit yield which is compared to the target yield to produce further control signals. The actual exit yield value may be modified within the processor by computed variations in the predicted dry yield using the same input sensors as in the start-up mode, and these modified signals are used to implement appropriate control actions to the tenter frame overfeed roll.

Other objects, advantages and features of the invention may become apparent from the following detailed description presented with the accompanying drawing.

DETAILED DESCRIPTION OF EMBODIMENT

Figure 1:
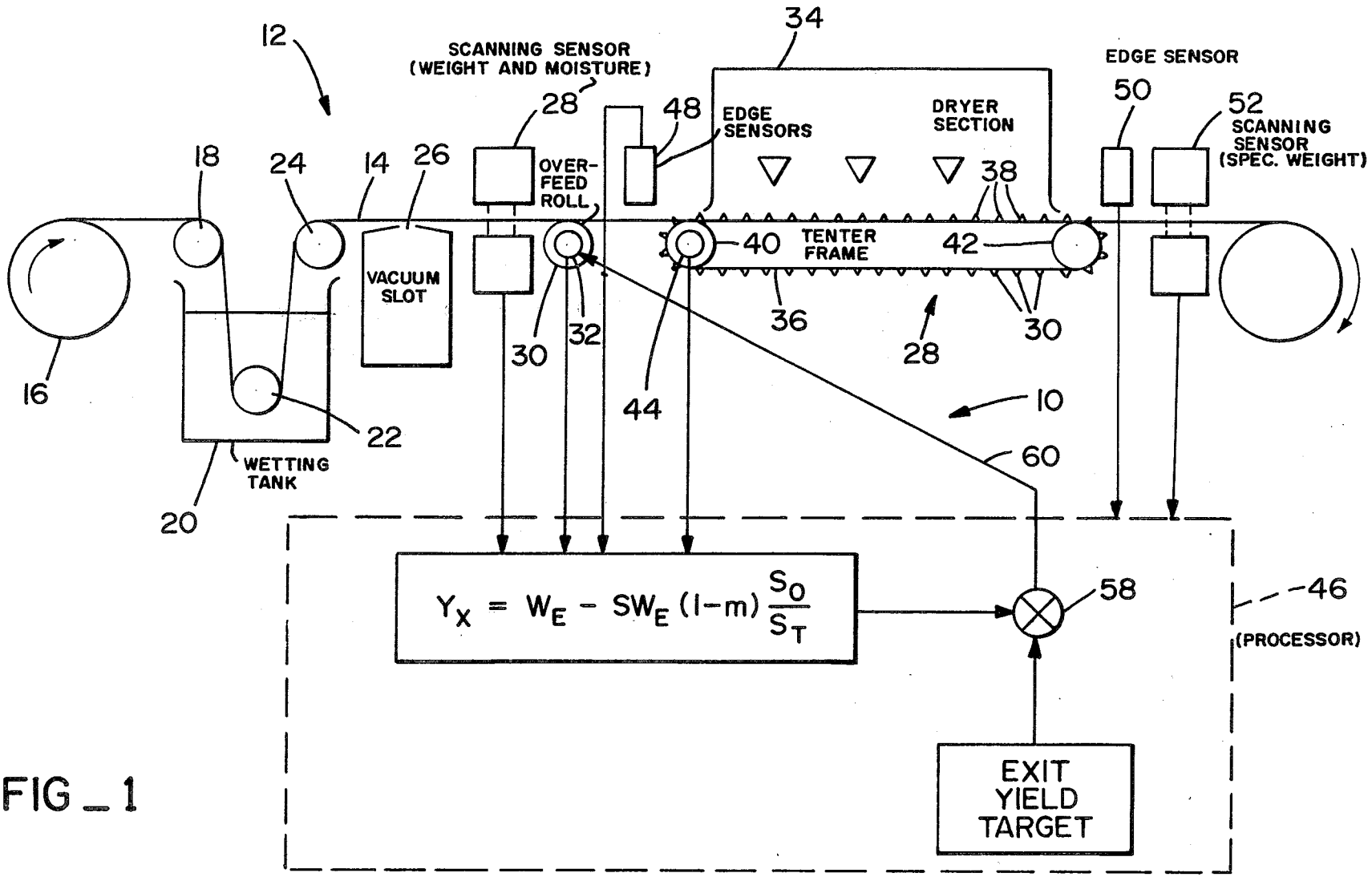
FIG. 1 is a schematic diagram of a control system for a tenter frame apparatus according to the invention showing control relationships when operating in the start-up or style change mode.

With reference to the drawing, a control system 10 is shown in FIG. 1 as it appears when controlling and monitoring a conventional textile tenter frame apparatus 12. In this apparatus, a fabric material 14, such as a knitted fabric, is fed from a supply roll 16 into the tenter line 12 for the treatment required before the fabric can be used to make garments. The material 14 is passed over a first guide roll 18 and thence into a wetting tank 20 where the fabric 14 is moistened and passed around a wetting tank guide roll 22. The fabric is lifted out of the tank 20 by a second guide roll 24, is passed over vacuum slot 26 and is then transferred through a scanning sensor device 28 to an overfeed roll 30. The overfeed roll 30, driven by a servo motor 32 feeds the fabric material 14 to the tenter frame 12 at a controlled rate. The tenter frame is normally within an enclosure 34 having a heat controlled dryer section. As the fabric material 14 is carried along by the tenter frame within the enclosure, the dryer section drives the moisture from material 14 and brings the temperature of the fabric up to the heat set temperature which causes it to shrink longitudinally.

As shown in FIG. 1, the tenter frame 12 comprises a pair of parallel, longitudinal belts 36, each carrying a series of upstanding plural engagement needles 38 in a spaced apart configuration which hold the fabric 14 to its original lateral size during the drying operation for holding the fabric. Each belt 36 is positioned to engage one edge portion of the fabric 14 and is passed around a driving sprocket 40 and an idler sprocket 42. A controlled servomotor 44 is mechanically linked to each driving sprocket 40. Hence, the speed of each tenter frame belt 36 is independently variable while the overall tenter frame speed may be controlled at a predetermined desired rate.

As the fabric passes from the vacuum slot 26 to the overfeed roll 30, it passes through the scanning sensor device 28 where measurement of the fabric specific weight and moisture are made and fed to a digital processor 46 which may be a special purpose minicomputer, or a general purpose computer connected to function properly. The scanning device, as well as the weight, and moisture sensors on it are components well known to those skilled in the art, and details on their structure and operation may be found in U.S. Pat. Nos. 3,757,122, 3,621,259 and 3,641,349. Simultaneously, the fabric entry width is measured by conventional edge sensors 48, which may be any suitable type, such as those utilizing photoelectric cells.

The speed of the overfeed roll 30 and the tenter driving sprockets 40 (and hence the belts 36) are measured by conventional tachometers (not shown) which provide speed proportional output signals.

At the exit end of the tenter frame 12, the treated fabric leaving the frame passes through an exit edge sensor 50 for measuring exit width and another scanning sensor 52 for measuring specific weight.

The signals produced by all of the sensing and measuring devices of the system 10 are supplied to the digital processor 46 wherein computations are made and control signals are produced in accordance with the principles of the invention.

In use, the system 10 has two modes of operation, and it may be readily switched either automatically or manually from one mode to another in order to maintain optimum yield in both modes. The first mode of operation, represented in FIG. 1, may be referred to as the start-up or style changing mode. The term "start-up" pertains to the initial phase of operation where a piece of fabric first moves into the tenter frame as it commences to function. In a similar manner, a "style change" mode of operation occurs when two types of fabric having different characteristics are connected together in line as a new type of material from the supply reel enters the tenter frame. The signal data produced at the exit and entry ends relates to two different materials. To maintain an optimum degree of accuracy, the control system must operate on data from the entry end only.

Thus, in this first mode of operation the scanning device 28 produces, for each scan of the fabric material, output signals representing its weight $W_E$ and moisture content ($m$). The edge sensors 48 provide an output signal representing the width of the fabric. The tachometers of the driving sprockets 40 and the overfeed roll 30 provide outputs representing the tenter fabric speed $S_t$ and the overfeed roll speed $S_o$. All of the aforementioned output signals are furnished to the processor 46 wherein they are computed to determine a predicted dry yield (Yx) in accordance with the following relationship:

$$Y_x = W_E \cdot SW_E \cdot (1 - m)\left(\frac{So}{ST}\right) \quad (1)$$

where $W_E$ = entry width $SW_E$ = entry specific weight $m$ = % moisture

So = overfeed speed $S_T$ = tenter sprocket drive speed

Within the processor, an exit yield target signal is provided which is generated by preselecting the desired exit yield and setting it into the processor. This preselected target signal is compared with the signal produced from the inputs computed in a summing section 58 of the processor in accordance with equation (1). An error signal is produced by the summing section 58 and is supplied by lead 60 to the servo-motor 32 of the overfeed roll 30. This causes the latter to vary its speed and thereby change the speed ratio $S_o/S_T$ in equation (1) so as to affect the exit yield. In this mode, new data is supplied to the processor with every scan of the entry scanning sensor device. Thus, when a fabric material with a different style or type enters the tenter, the exit yield predicted will accurately reflect its characteristics.

Figure 2:
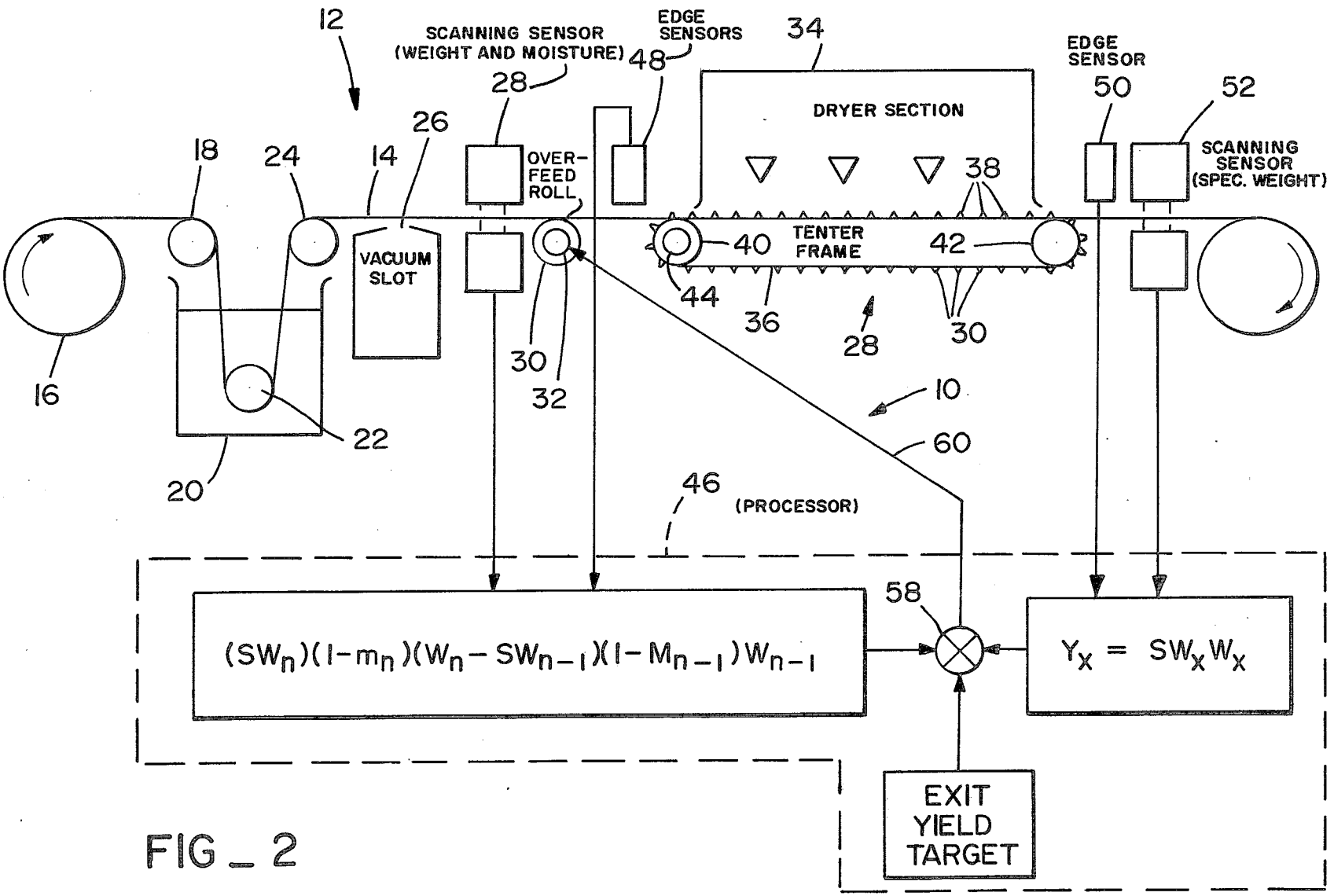
FIG. 2 is a schematic diagram of the control system according to the invention as it appears when operating in the steady state mode.

When a continuous strip of fabric material having uniform style characteristics is passing through the tenter frame 12, a steady state mode of operation for controlling yield, as represented in FIG. 2, may be used in accordance with the invention. In this mode the yield control is refined by utilizing inputs to the processor furnished by the exit edge sensor 50 and the exit scanning sensor 52. The exit edge sensor provides an input equal to the fabric width ($W_X$) and the scanning sensor provides an input equal to fabric weight (S). These inputs are applied to the processor wherein they are computed to provide a value for actual exit yield in accordance with the relation:

$$Y_x = SW_x \cdot W_x \quad (2)$$

where:

$Y_x$ is exit yield $SW_x$ is the specific weight at exit $W_x$ is the fabric width at exit In the steady state mode, small variations in entry conditions of the fabric material may occur which should be taken into account along with the actual yield being produced at the exit end of the tenter frame. Thus, a correction factor for any change in predicted dry yield based on variations between one scan ($n$) of the scanning sensor device at entry compared with the preceding scan ($n-1$) is utilized in the processor. This change in predicted dry yield may be represented by the following formula:

$$\Delta Y_x = (SW_n)(1 - M_n)(W_n) - (SW_{n-1}(1-M_{n-1})(W_{n-1}) \quad (3)$$

where:

$\Delta Y_x$ is the variation in predicted dry yield between scans $n$ and $n-1$.

SW is the basis weight

M is the moisture percentage

W is the entry width

As shown on FIG. 2, the corrective factor accounting for small changes in entry yield as obtained by formula (3) and applied within the processor via lead 60 to the servo-motor 32 of the overfeed roll 30. The actual yield ($Y_x$) obtained from formula (2) is summed with the present exit yield target to produce a control signal which is applied via lead 60 to the servo-motor 32 of the overfeed roll 30 with appropriate compensation for transport lag between the overfeed roll 30 and the exit scanner 52.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. In combination with a textile tenter frame including a pair of spaced apart belts driven by a drive means and an overfeed roll at the entry end of said frame, and a sheet of fabric entering said frame from a source apparatus for controlling the yield of said fabric at the exit end of said frame comprising:

moisture and weight sensor means at the entrance of said frame measuring the moisture content and source weight of the fabric before entering the tenter frame for producing output signals proportional to the measured moisture content and measured source weight of the fabric before entering the tenter frame;

edge sensor means at opposite edges of said fabric sheet at the entrance of said frame for producing output signals proportional to the width of the fabric before entering the tenter frame;

speed sensor means connected to said belts and to said overfeed roll for producing output signals proportional to the speed of said tenter frame belts and said overfeed roll;

electronic computer control means connected to each of said sensor means and including means for receiving each of said output signals from each of said sensor means, means for repetitively computing a predicted exit yield signal from said output signals, means for generating a predetermined target yield signal, means for comparing said predicted exit yield signal to said target yield source to provide a control output signal corresponding to the difference between said target yield signal and said predicted exit yield signal; and said control output signal being supplied to said overfeed roll to vary the speed thereof in accordance with said control output signal in order to control the actual yield of said fabric at the exit end of said frame.

2. In combination with a textile tenter frame including a pair of spaced apart belts driven by a drive means and an overfeed roll at the entry end of said frame, and a sheet of fabric entering said frame from a source apparatus for controlling the actual yield of said fabric at the exit end of said frame comprising:

entrance sensor means at the entrance of said frame for producing output signals proportional to the measured entrance moisture content and measured entrance weight of the fabric before entering the tenter frame;

entrance edge sensor means at opposite edges of said fabric sheet at the entrance of said frame and for producing output signals proportional to the entrance width of the fabric before entering the tenter frame;

exit sensor means at the exit end of said frame for scanning said fabric and for producing output signals proportional to the measured exit weight of the fabric leaving the tenter frame;

exit edge sensor means at opposite edges of said fabric sheet at the exit end of said frame for producing output signals proportional to the measured width of the fabric leaving the tenter frame; and electronic computer control means connected to each of said sensor means and including means for receiving output signals from each of said sensor means, means for repetitively computing predicted dry yield signals from said entrance sensor output signals and providing a correction factor signal proportional to variations between said repetitive computed dry yield signals, means for computing an exit yield signal from said exist sensor output signals, means for generating a predetermined target yield signal, means for comparing the computed exit yield signal to said target yield signal and providing a control output signal;

said electronic computer control means further including means for supplying said correction factor signal and said control output signal to said overfeed roll to vary the speed thereof in accordance with both of said signals in order to control the actual yield of said fabric at the exit end of said frame.

3. The apparatus as described in claim 2 including means in said computer control means connected for computing said exit yield signal by multiplying said exit sensor means output signals by said exit edge sensor means output signals, and for computing said correction factor signal by subtracting a quantity expressed by the product of a measured entrance weight output signal of a first measurement times unity minus a measured percentage entrance moisture content output signal of said first measurement times an entrance width output signal of said first measurement from the quantity expressed by the product of a measured entrance weight output signal of a second measurement times unity minus a measured percentage entrance moisture content output signal of said second measurement times an entrance width output signal of said second measurement.

4. The apparatus as described in claim 2 wherein said sensor means are mounted for scanning transversely across the fabric material.

5. A method for controlling the yield of textile material issuing from a textile tenter frame apparatus having a pair of spaced apart belts driven by drive sprockets and an overfeed roll near its entry end, said method comprising the steps of:

sensing and providing input signals proportional to the width, moisture content and specific weight of the textile material just prior to its entrance into the tenter frame;

sensing and providing input signals proportional to the ratio of tenter frame belt speed to the overfeed roll speed;

combining said input signals to produce a predicted dry yield exit value for the fabric entering the tenter frame;

comparing said predicted dry yield exit value with a preset target yield value to product a control output signal; applying said control output signal to said overspeed roll to regulate the speed thereof so that said predicted yield exit value approaches said target yield value.

6. A method for controlling the yield of textile material issuing from a textile tenter frame apparatus having a pair of spaced apart belts driven by drive sprockets and an overfeed roll near its entry end, said method comprising the steps of:

sensing and producing outflow signals proportional to the width and specific weight of the textile material at the exit end of the tenter frame;

combining said outflow signals to produce an actual yield value for material emerging from the tenter frame;

comparing said actual yield value with a preselected target yield to produce a control output signal;

repetitively scanning the textile material to sense the width, moisture content and specific weight thereof just prior to its entrance into the tenter frame;

calculating from each said scan a predicted dry yield exit value for said material;

comparing a dry yield exit value of one scan with a dry yield exit value of a subsequent scan to produce a modifying signal proportional to the difference therebetween; and applying said control output signal and said modifying signal to said overfeed roll of the apparatus to vary its speed and thereby cause the actual output to approach said target yield.

7. The method for controlling the yield of material from a textile tenter frame as described in claim 6 wherein said modifying signal for change in predicted dry yield is derived from the relationship $$\Delta Y_{\underset{(W_{n-1})}{r}} = (SW_n)(1 - M_n)(W_n) - (SW_{n-1})(1 - M_{n-1})$$

where

SW is the measured specific weight;

M is the measured moisture content;

W is the fabric width; and $n$ and $n-1$ represent successive data inputs.

* * * * *